US006988532B2

(12) United States Patent
Hamada

(10) Patent No.: US 6,988,532 B2
(45) Date of Patent: Jan. 24, 2006

(54) HEAT EXCHANGER

(75) Inventor: Hiroshi Hamada, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/973,988

(22) Filed: Oct. 26, 2004

(65) Prior Publication Data

US 2005/0109487 A1 May 26, 2005

(30) Foreign Application Priority Data

Oct. 27, 2003 (JP) ..... 2003-366238

(51) Int. Cl.
*F28F 9/007* (2006.01)
*F28F 9/26* (2006.01)

(52) U.S. Cl. ..... 165/67; 165/69; 165/144; 165/149

(58) Field of Classification Search ..... 165/67, 165/69, 144, 149, 906; 180/68.4

See application file for complete search history.

(56) References Cited

U.S. PATENT DOCUMENTS 1,695,519 A * 12/1928 Young ..... 165/149
2,056,318 A * 10/1936 Hammond ..... 165/149
3,776,301 A * 12/1973 Young ..... 165/67
5,137,080 A 8/1992 Haasch et al.
5,228,511 A * 7/1993 Boquel et al. ..... 165/149

FOREIGN PATENT DOCUMENTS

JP 5-215475 8/1993

* cited by examiner

*Primary Examiner*—Leonard R. Leo
(74) *Attorney, Agent, or Firm*—Harness, Dickey & Pierce, PLC

(57) ABSTRACT

An angle member 9 is fixed to an insert 5 in a state in which a mounting portion 9*a* of the angle member 9 is fitted in a groove portion 5*a* depressed towards a core portion 4 side, whereby there is no case where an impact force applied to the angle member 9 and a connecting bar is transmitted directly to tubes 2, so that a possibility that a damage such as a crack is generated in the tubes 2 can be reduced. Consequently, the large vibration of a heat exchanging unit 7 can be suppressed while preventing the direct transmission of the impact force applied to the angle member 9 to the tubes 2.

9 Claims, 7 Drawing Sheets

HEAT EXCHANGER

BACKGROUND OF THE INVENTION

1. Field of the Invention

The present invention relates to a heat exchanger and, more particularly, to a heat exchanger which is effective when applied to a radiator of large construction vehicles such as bulldozers and shovel loaders and agricultural vehicles such as farm tractors.

2. Description of the Related Art

Radiators for special-purpose vehicles such as large construction and agricultural vehicles are made up of a plurality of small radiators or a plurality of heat exchanging units which are arranged in parallel with the flow of cooling air, and each heat exchanging unit has the same construction as a normal radiator which is made up of a plurality of tubes through which coolant is caused to flow (for example, see Japanese Unexamined Patent Publication No. 5-215475).

Incidentally, as the dimension of a location of the heat exchanging unit which extends in parallel with the longitudinal direction of the tubes, that is, the height of the single heat exchanging unit, is larger than the width of the single heat exchanging unit, that is, the dimension of a location of the heat exchanging unit which extends to intersect with the longitudinal direction of the tubes at right angles, the single heat exchanging unit forms a long elongated pillar-like shape.

In addition, as each heat exchanging unit is assembled to the special-purpose vehicle such as the construction vehicle via header tanks which communicate with each heat exchanging unit, the long elongated pillar-shaped heat exchanging unit is constructed to be supported at longitudinal ends thereof. Due to this, the heat exchanging unit is easily caused to resonate at a primary frequency of a large amplitude having nodes at the longitudinal ends thereof.

To cope with this, while there are countermeasures in which an angle member is provided at a substantially longitudinal center of the plurality of tubes which constitute the heat exchanging unit for connecting together the respective tubes thereat, and a connecting bar to which the angle member fixed to each heat exchanging unit is connected, is fixed to the vehicle, these countermeasures have the following problems.

Namely, in the aforesaid countermeasures, as the angle member is directly fixed to the tubes, an impact force applied to the angle member is transmitted directly the tubes, and this increases a probability that damage such as cracking is generated in the tubes.

In addition, in a case where a corrugated fin is joined to the external surface of the tube, the respective tubes cannot be connected to the angle member using a means for making insertion holes in the angle member so that the tubes are passed through the insertion holes so made.

Furthermore, as it is difficult for cooling air to flow into the heat exchanging unit (a core portion) at a location of the heat exchanging unit where the angle member is provided due to the angle member constituting an obstacle, the radiator cannot sufficiently exhibit its heat radiating capacity.

SUMMARY OF THE INVENTION

The present invention was made in the above situation, and a primary object of the invention is to provide a novel heat exchanger which differs from the conventional ones, and a secondary object of the invention is to suppress the large vibration of a heat exchanging unit while preventing the direct transmission of at least an impact force applied to an angle member to tubes.

With a view to attaining the objects, according to the invention, there is provided a heat exchanger comprising a plurality of heat exchanging units (7) each having a core portion (4) comprising, in turn, a plurality of tubes (2) through which fluid is caused to flow and inserts (5) provided on both sides of the core portion (4) in such a manner as to extend in parallel with a longitudinal direction of the tubes (2) so as to reinforce the core portion (4), angle members (9) fixed to the heat exchanging units (7) at locations of the inserts (5) which face longitudinally intermediate portions of the tubes (2) and a connecting bar **(9*d*) to which the angle member (9) fixed to each of the plurality of heat exchanging units (7)** is connected.

By this configuration, as the direct transmission of the impact force applied to the angle members (9) and connecting bars **(9*d*) to the tubes (2) can be prevented, the possibility can be reduced that damage, such as cracks, is generated in the tubes (2)**.

In addition, as the longitudinally intermediate portions of the tubes (2) of the heat exchanging unit (7) can be secured via the angle members (9) and the connecting bar **(9*d*), the heat exchanging unit (7) vibrates with longitudinal ends and the locations thereof where the angle members (9)** are provided functioning as nodes. Due to this, as the distance between the nodes becomes shorter than when there is provided no angle member, the maximum amplitude is reduced as the distance is reduced.

Consequently, the large vibration of the heat exchanging unit (7) can be suppressed while preventing the direct transmission of the impact force applied to the angle members (9) to the tubes (2).

According to the invention, the angle member (9) is fixed to the heat exchanging unit (7) while being fitted in a groove portion **(5*a*) formed in the location of the insert (5) which faces the longitudinally intermediate portion of the tube (2)**.

By this configuration, the angle member (9) can be fixedly assembled to the insert (5) in an ensured fashion while the angle member (9) is prevented from deviating from the insert (5), that is, the heat exchanging unit (7).

According to the invention, the groove portion **(5*a*) extends substantially in parallel with a direction in which an external fluid which exchanges heat with the fluid flows in a state where the groove portion (5*a*) is depressed towards the core portion (4)** side.

By this configuration, as the interference of the angle member (9) with the insert (5) of the adjacent heat exchanging unit (7) can be prevented, the dimension of a gap between the two adjacent heat exchanging units (7) can be reduced, thereby making it possible to make the entirety of the heat exchanger smaller.

According to the invention, the angle member (9) has mounting portions **(9*a*) fitted in the groove portions (5*a*) and a connecting portion (9*b*) which extends across the core portion (4) in such a manner as to connect the two mounting portions (9*a*)** and is formed substantially into a U shape.

According to the invention, the groove portion **(5*a*) has a stepped portion (5*b*) having a groove width which is wider than a groove width of an opening on the connecting portion (9*b*) side into which the mounting portion (9*a*)** is fitted.

By this configuration, the positioning of the angle member can be implemented with high accuracy.

According to the invention, a gap **(9*c*) through which the external fluid is caused to flow is provided between the connecting portion (9*b*) and the core portion (4)**.

By this configuration, the heat radiating capacity of the heat exchanger can be exhibited sufficiently.

According to the invention, the plurality of heat exchanging units (7) are arranged in parallel with each other in a direction in which the external fluid flows.

According to the invention, the plurality of angle members (9) and the connecting bar (9*d*) are connected to each other by a detachable fastening means (9*e*).

According to the invention, a fin (3) which is formed into a corrugated form as viewed in the direction in which the external fluid flows is joined to an external surface of the tube (2).

The present invention will be understood more fully from the accompanying drawings and preferred embodiments of the invention which will be described below.

DESCRIPTION OF PREFERRED EMBODIMENTS (First Embodiment)

Figure 1:
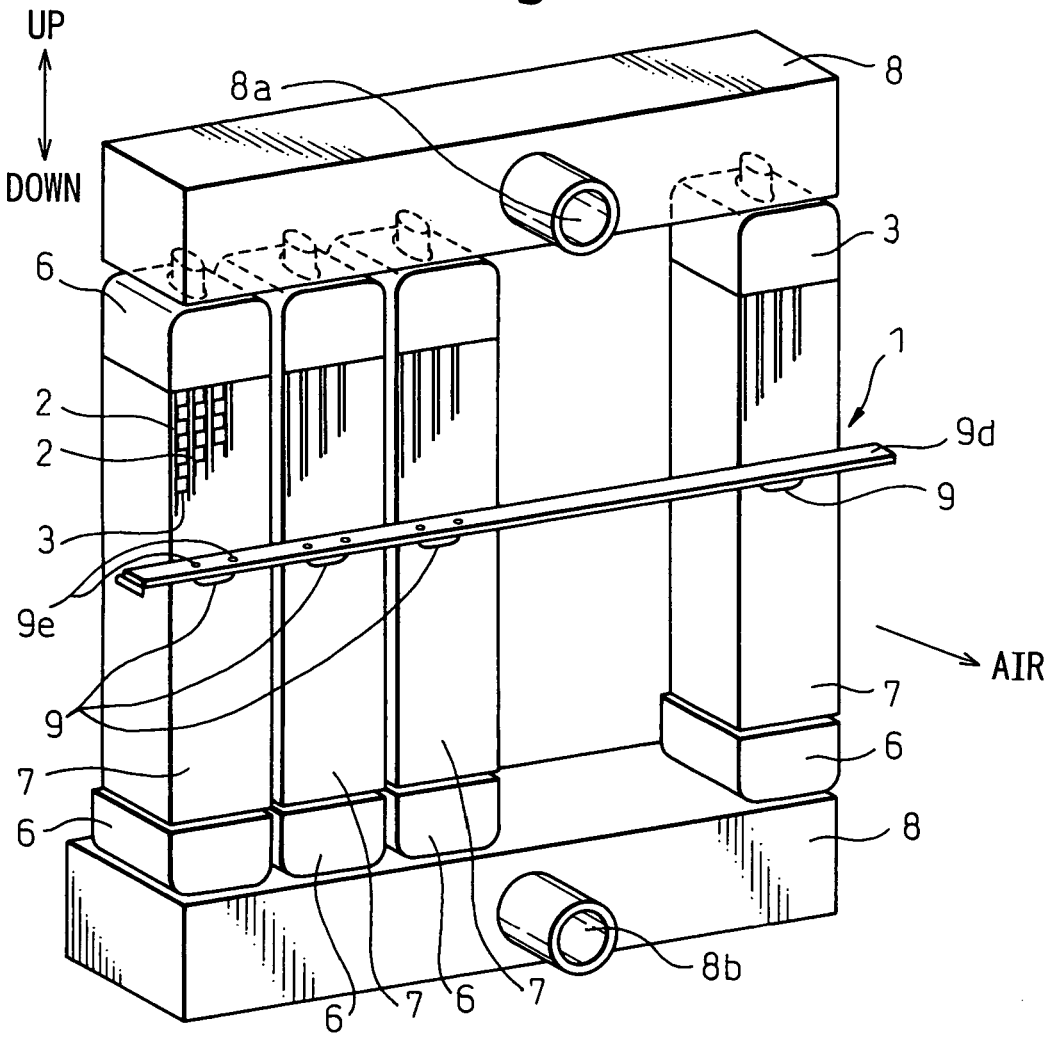
FIG. 1 is a perspective view showing an external appearance of a radiator according to a first embodiment of the invention.

According to a first embodiment, the invention is applied to a radiator for large construction vehicles such as bulldozers and shovel loaders. FIG. 1 is a perspective view showing an external appearance of a radiator 1 according to the first embodiment, FIG. 2 is an exemplary drawing showing a state in which the radiator 1 is installed, and FIG. 3 is a drawing showing a main part of the embodiment.

Figure 2:
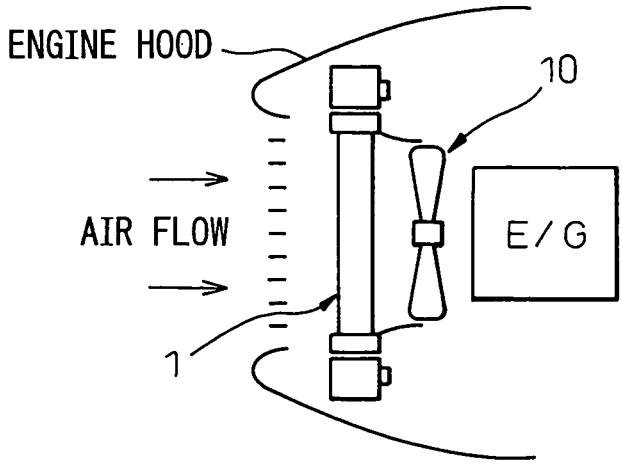
FIG. 2 is an exemplary drawing showing a typical state in which the radiator according to the first embodiment of the invention is installed.

In addition, as shown in FIG. 2, the radiator 1 is placed such that cooling air blown from a blower 10 installed on a downstream side of the flow of air strikes the radiator 1, and the blower 10 operates by obtaining power from an engine E/G.

As shown in FIG. 1, the radiator 1 is such as to constitute a single heat exchanger by combining a plurality of heat exchanging units 7 which are each configured into a long pillar-like shape, and in this embodiment, the heat radiating capacity of the single heat exchanging unit 7 is set at on the order of about 100 to 200 W.

Figure 3:
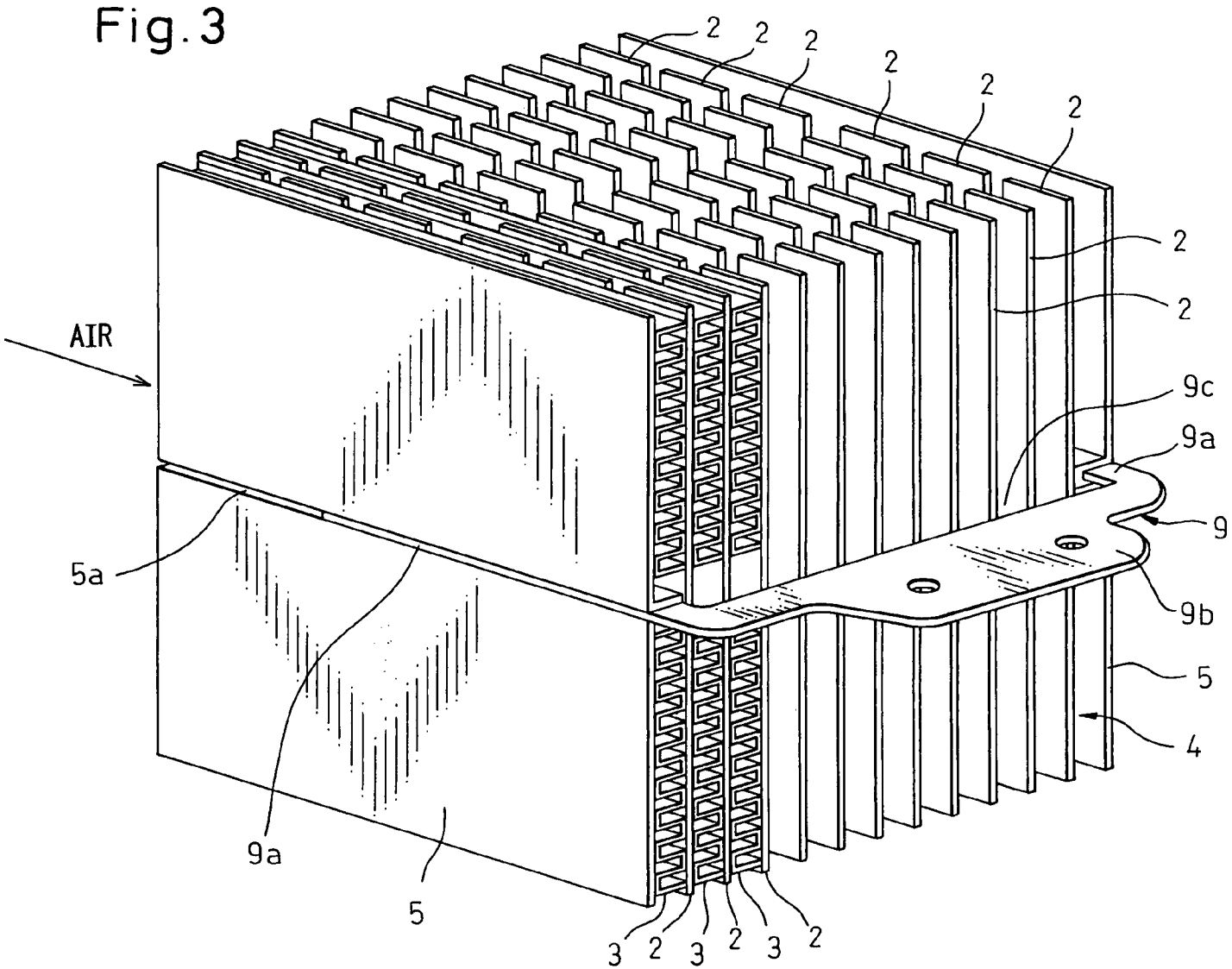
FIG. 3 is a drawing showing a main part of the first embodiment of the invention.

In addition, as shown in FIG. 3, each heat exchanging unit 7 is such as to include a plurality of tubes 2 and fins 3, inserts 5 for reinforcing a core portion 4 and header tanks 6 (refer to FIG. 1), and in this embodiment, the tubes 2, fins 3, inserts 5 and header tanks 6 are made of metal such as aluminum alloy and are joined together via brazing.

Note that brazing is a technique, as described in, for example, a publication entitled "Connecting and Joining Technique" (by Tokyo Denki University Publication Bureau), for joining workpieces together without melting them using brazing material or solder, and it is referred to as brazing that joining is implemented using a filler metal whose melting point is 450° C. or higher, and a filler metal used is called solder.

Here, the tube 2 is a tube formed into a flat shape for passage of engine coolant, and the fin 3 is joined to an external surface of the flat shape. In addition, the fin 3 according to the embodiment is formed into a wavy shape such as sine wave or rectangular wave as viewed in a direction in which cooling air which exchanges heat with the engine coolant is caused to flow or from the front of the radiator 1.

In addition, the insert 5 is a reinforcing member which is provided on both sides of the core portion 4 in such a manner as to extend in parallel with the longitudinal direction of the tubes 2 so as to reinforce the core portion 4. The header tank 6 is arranged at both ends of the longitudinal direction of the plurality of tubes 2 in such a manner as to communicate with these tubes 2, and the header tank 6 placed at longitudinally upper ends of the tubes 2 is such as to distribute and supply the engine coolant to the plurality of tubes 2, whereas the header tank 6 placed at longitudinally lower ends of the tubes 2 is such as to collect thereinto the engine coolant which has completed a heat exchange with air.

Then, each heat exchanging unit 7 is, as shown in FIG. 1, connected to secondary header tanks 8, and the secondary header tank 8, shown as being placed upper on the drawing, distributes and supplies the coolant discharged from an engine E/G to the header 6 of each heat exchanging unit 7, whereas the secondary header tank 8, shown as being placed lower on the drawing, collects the engine coolant that has completed heat exchange from the header tank 6 of each heat exchanging unit 7 thereinto and return it to the engine E/G.

Note that a coolant intake port 8*a* is provided on the secondary header tank 8 arranged upper on the drawing of FIG. 1, whereas a coolant outlet 8*b* is provided on the secondary header tank 8 arranged lower on the drawing of FIG. 1.

Incidentally, an angle member 9 is fixed to each heat exchanging unit 7 and, as shown in FIG. 3, this angle 9 has mounting portions 9*a* which are fixed to the inserts 5 and has a connecting portion 9*b* which extends across the core portion 4 to connect these two mounting portions 9*a* and is formed substantially into a U shape, a gap 9*c* being provided between the connecting portion 9*b* and the core portion 4 for passage of cooling air.

Then, the angle member 9, that is, the mounting portion 9*a*, is fixedly brazed to the insert 5 in a state the mounting portion 9*a* is fitted in a groove portion 5*a* provided on the insert 5 at a location thereof which faces a longitudinally intermediate portion of the tube 2 the instant the tubes 2 are brazed. Incidentally, in this embodiment, the angle member 9 is made of a metallic material such as aluminum alloy.

In addition, the groove portion 5*a* is such as to extend substantially in parallel with the direction in which cooling air flows in a state in which the groove portion 5*a* is depressed into the core portion 4 side, and in this embodiment, the groove portion 5*a* is formed when the insert 5 is pressed.

Note that, as shown in FIG. 1, while the angle member 9 is fixed to the single location of the insert 5 which faces the substantially longitudinally central portion of the tube 2, the embodiment is not limited thereto, and the angle member 9 may be fixed to the insert 5 at a plurality of locations thereof depending on the longitudinal dimension of the tube 2.

Then, the angle member 9 fixed to each heat exchanging unit 7 is fixed a connecting bar 9*d* which extends in a direction parallel with the longitudinal direction of the secondary header tank 8, and in this embodiment, each angle member 9 is fixed to the connecting bar 9*d* by fixing the connecting portion 9*b* of the angle member 9 to the connecting bar 9*d* with detachable fastening means such as bolts 9*e*.

Note that the connecting bar 9*d* and the secondary header tanks 8 are fixed to the vehicle with the fastening means such as bolts and pins 9*e*.

Next, the function and advantage of the embodiment will be described.

In this embodiment, as the inserts 5 are fixed to the angle member 9, there is no case where the impact force applied to the angle member 9 and the connecting bar 9*d* is transmitted directly to the tubes 2, whereby the possibility that damage, such as cracking generated in the tubes 2, can be reduced.

In addition, as the longitudinally intermediate portions of the tubes 2 of the long pillar-like heat exchanging unit 7 are connected to the vehicle via the angle member 9 and the connecting bar 9*d*, each heat exchanging unit 7 vibrates at the longitudinal ends and the location where the angle 9 is provided which function as nodes. Due to this, as the distance between the nodes is shorter, compared with a case where there is provided no angle member 9, the maximum amplitude also becomes smaller as the distance becomes shorter.

Consequently, the large vibration of the heat exchanging unit 7 can be suppressed while preventing the direct transmission of the impact force acting on the angle member 9 to the tubes 2.

In addition, as the gap 9*c* is provided between the connecting portion 9*b* and the core portion 4 for passage of cooling air, cooling air can also be supplied to the location of the heat exchanging unit 7 (the core portion 4) where the angle member 9 is provided, this allowing the heat radiating capacity of the radiator 1 to be exhibited sufficiently.

Additionally, as the groove portion 5*a* is provided in the insert 5 and the mounting portion 9*a* of the angle member 9 is fitted in the groove portion 5*a* so provided, the angle member 9 can be fixedly assembled to the insert 5 (the heat exchanging unit 7) in an ensured fashion while preventing the deviation of the angle member 9 relative to the insert 5 (the heat exchanging unit 7).

Furthermore, as the groove portion 5*a* is formed in such a manner as to be depressed into the core portion 4 side, the interference of the angle member 9, that is, the mounting portion 9*a*, with the insert 5 of the adjacent heat exchanging unit 7 can be prevented, whereby a gap dimension between the adjacent heat exchanging units 7 can be reduced, so that the entirety of the radiator 1 can be made smaller.

(Second Embodiment)

While the angle member 9 according to the first embodiment is flat, in a second embodiment, as shown in FIGS. 4A, 4B and 5A, 5B, a bent portion is provided partly on an angle member 9, so that the bending rigidity of the angle member 9 itself is enhanced.

Figure 4A:
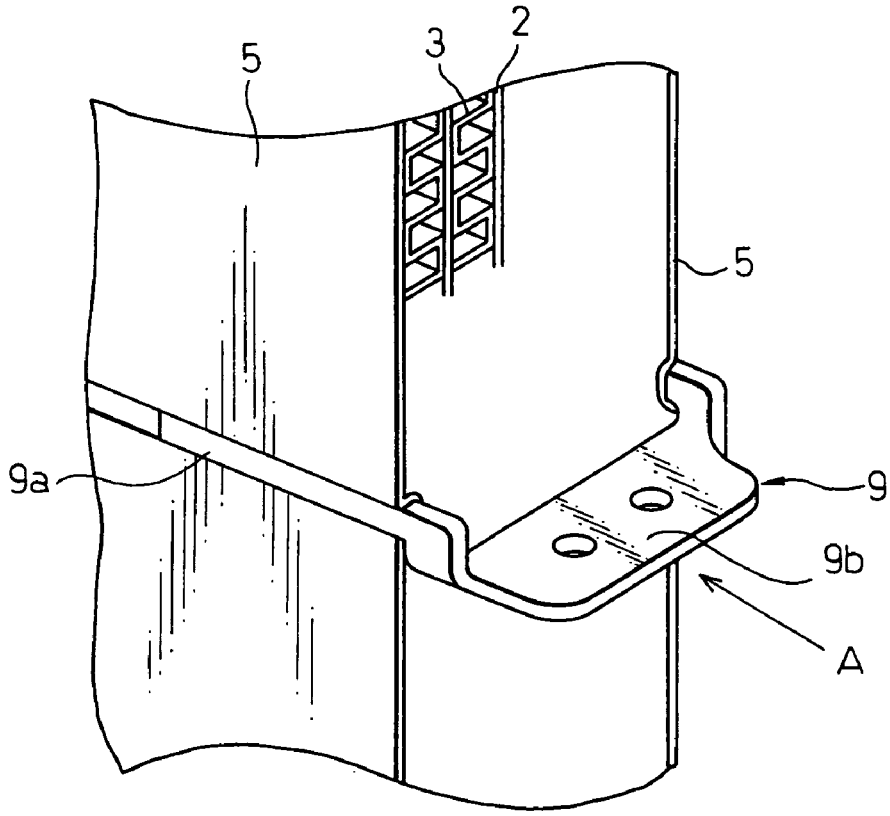
FIG. 4A is a drawing showing a main part of a second embodiment of the invention.
Figure 4B:
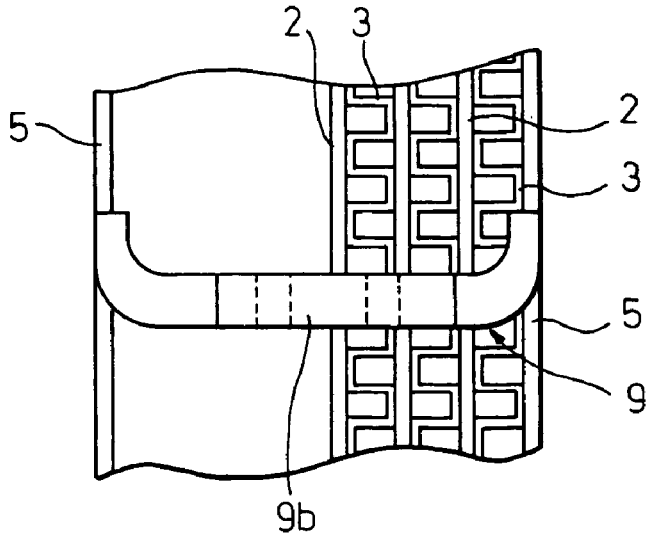
FIG. 4B is a view as seen in a direction indicated by an arrow A in FIG. 4A.
Figure 5A:
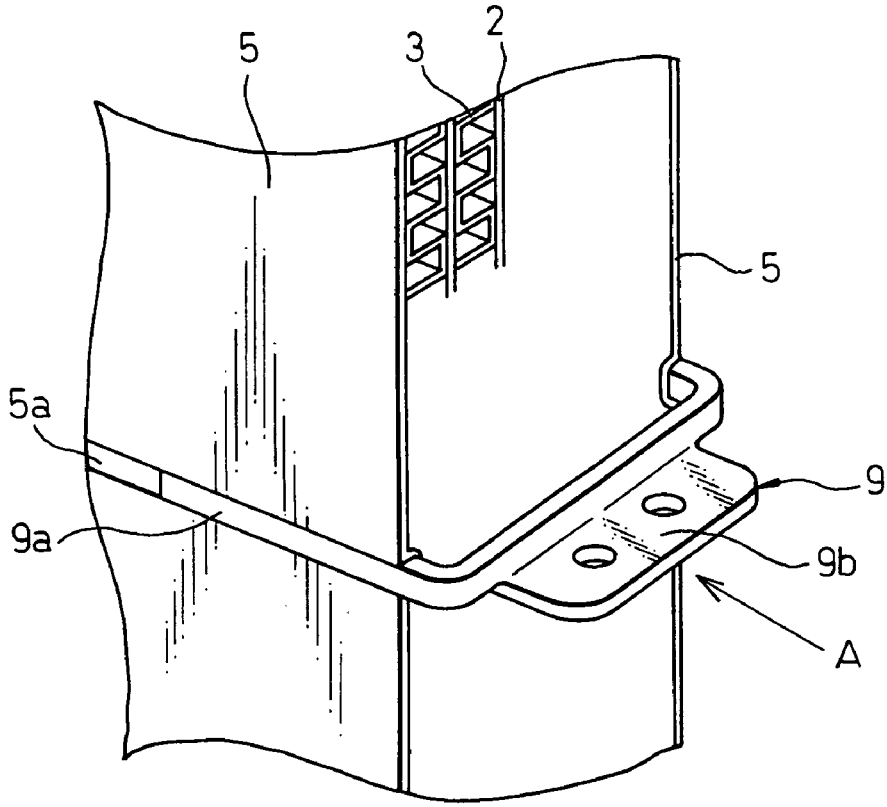
FIG. 5A is a drawing showing a main part of a third embodiment of the invention.
Figure 5B:
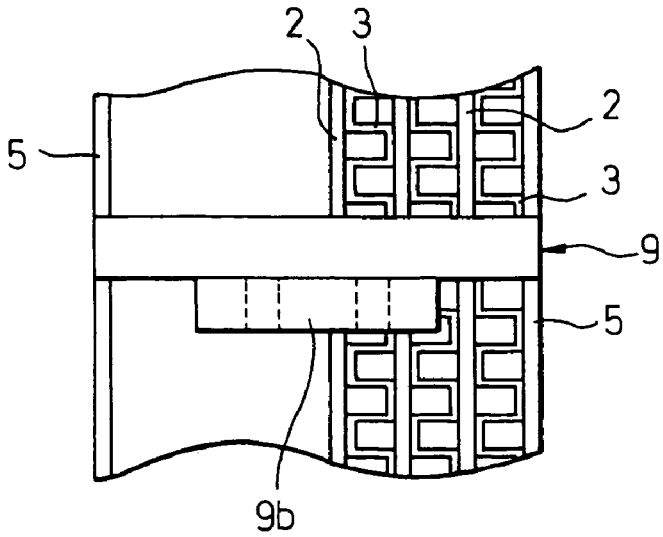
FIG. 5B is a view as seen in a direction indicated by an arrow A in FIG. 5A.

Note that in FIG. 4A, a mounting portion 9*a* is bent at substantially 90° relative to a connecting portion 9*b* so as to form the bent portion whereas, in FIG. 5A, a connecting portion 9*b* is bent at substantially 90° relative to a mounting portion 9*a* so as to form the bent portion.

(Third Embodiment)

Figure 6A:
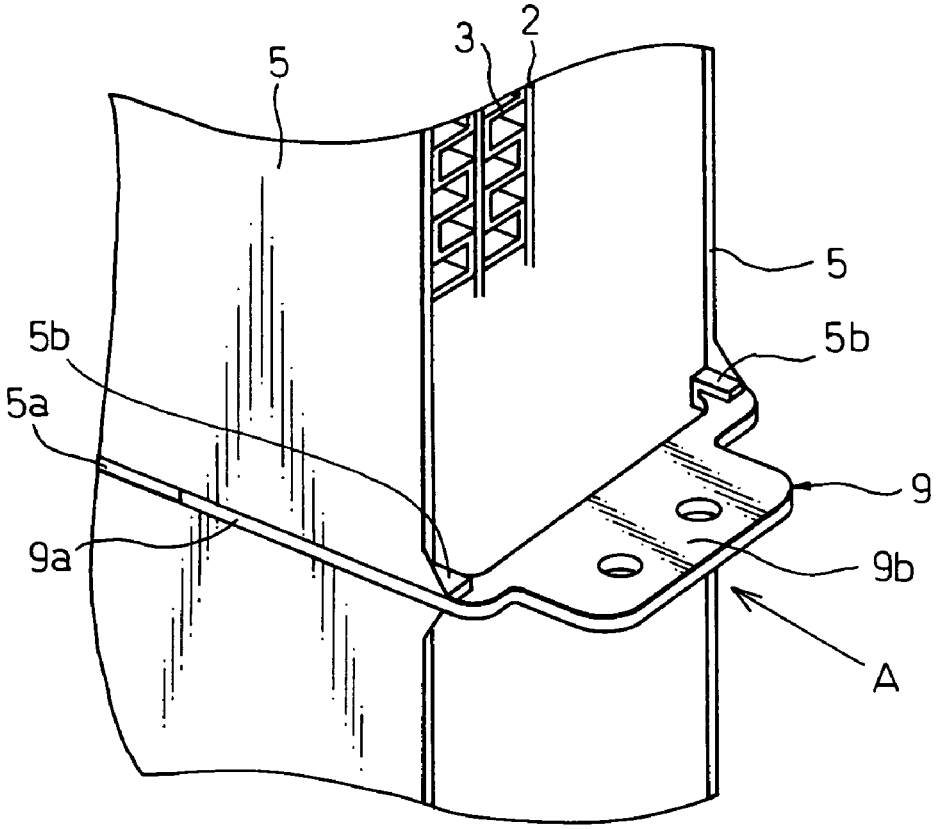
FIG. 6A is a drawing showing a main part of a fourth embodiment of the invention.
Figure 6B:
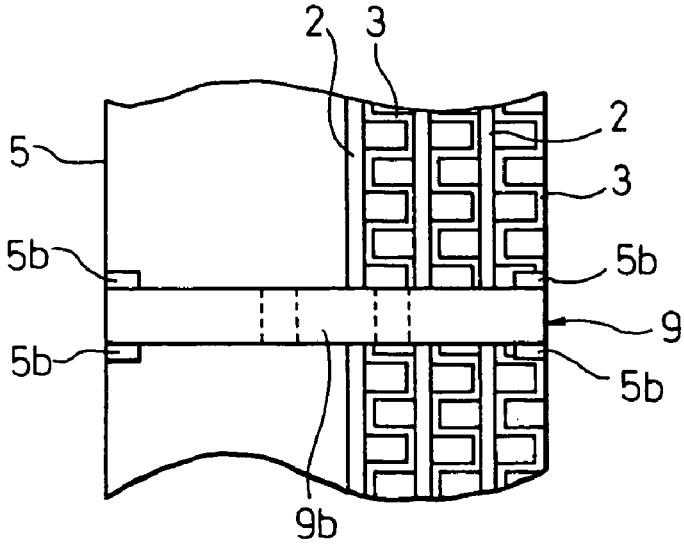
FIG. 6B is a view as seen in a direction indicated by an arrow A in FIG. 6A.

In a third embodiment, as shown in FIGS. 6A, 6B, a vertical wall reinforcing portion 5*b* is provided at a longitudinal end portion of a groove portion Sa which faces an insertion opening side of an angle member 9 in such a manner as to protrude towards a connecting portion 9*b* side so as to support an angle member 9 (a mounting portion 9*a*).

Note that while the vertical wall reinforcing portion 5*b* is integrally formed via plastic working such as pressing, the embodiment is not limited thereto.

(Fourth Embodiment)

Figure 7:
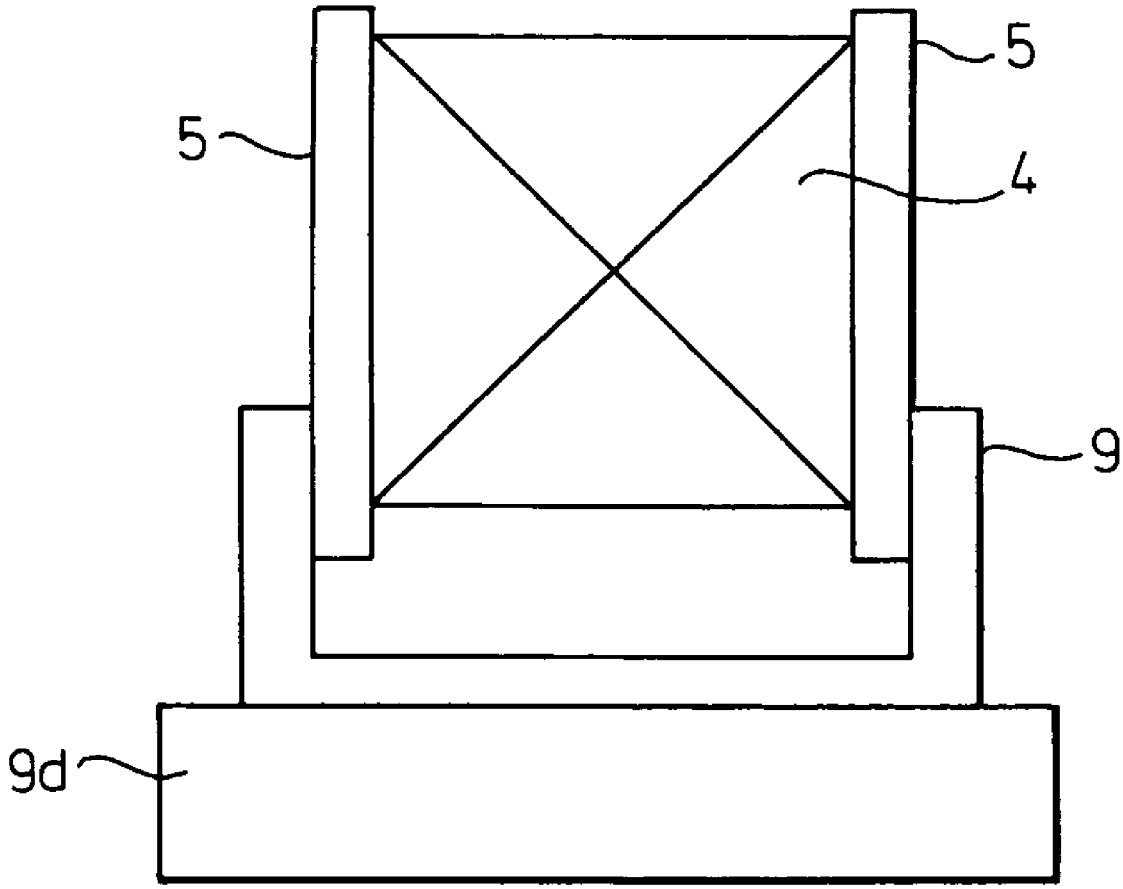
FIG. 7 is a drawing showing a main part of a fifth embodiment of the invention.

While, in the first to third embodiments, the connecting portions 9*b* and the connecting bar 9*d* are fixed together with the fastening means such as the bolts 9*e* in a state where they overlap in the direction parallel with the longitudinal direction of the tubes 2, in a fourth embodiment, as shown in FIG. 7, a connecting portion 9*b* and a connecting bar 9*d* overlap in the direction in which air flows so that they are fastened together with fastening means such as bolts.

Note that FIG. 7 shows a view showing a heat exchanging unit 7 and the connecting bar 9*d* as viewed in a direction parallel with the longitudinal direction of tubes 2.

(Fifth Embodiment)

As shown in FIGS. 8A to 8E, a fifth embodiment is characterized in that a stepped portion 5*b*, having a groove width d2 which is wider than a groove width d1 into which a mounting portion 9*a* of an angle member 9 is fitted, is provided in an opening in a groove portion 5*a* in an insert 5 which faces a connecting portion 9*b*.

Figure 8A:
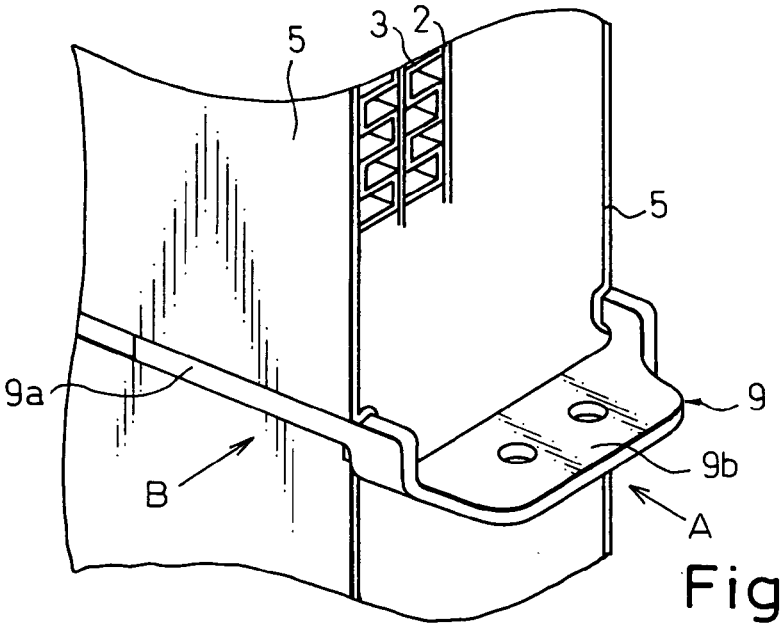
FIG. 8A is a drawing showing the main part of the fifth embodiment of the invention.
Figure 8B:
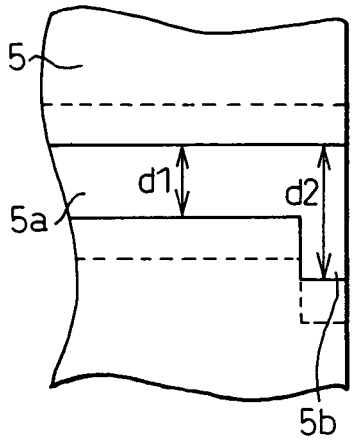
FIG. 8B is a view showing an insert 5 as seen in a direction indicated by an arrow B in FIG. 8A.
Figure 8C:
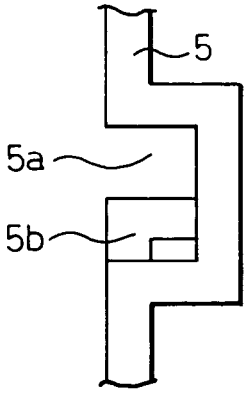
FIG. 8C is a view showing the insert 5 as viewed in a direction indicated by an arrow A in FIG. 8A.
Figure 8D:
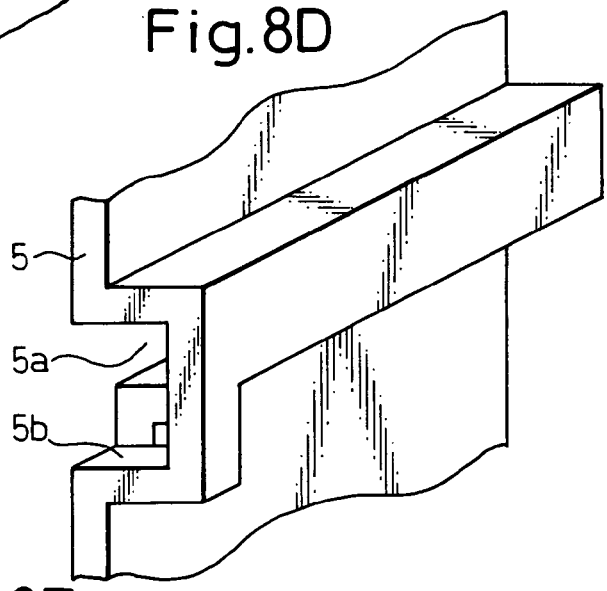
FIG. 8D is a perspective view of the insert.
Figure 8E:
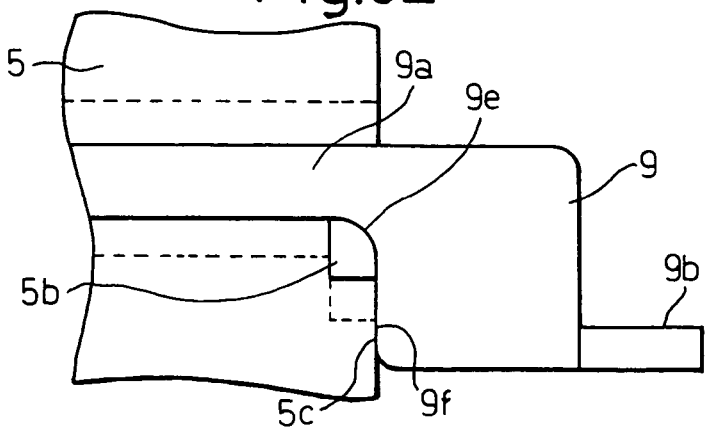
FIG. 8E is a view showing a state in which an angle member 9 is fitted in the insert 5 as seen in the direction indicated by the arrow B in FIG. 8A.

Here, FIG. 8A is a drawing showing a main part of the fifth embodiment, FIG. 8B is a view showing the insert 5 as seen in a direction indicated by an arrow B in FIG. 8A, FIG. 8C is a view showing the insert 5 as seen in a direction indicated by an arrow A in FIG. 8A, FIG. 8D is a perspective view of the insert 5, and FIG. 8E is a view showing a state in which an angle member 9 is fitted in the insert 5 as seen in the direction indicated by the arrow B in FIG. 1.

The angle member 9 used in the fifth embodiment is such that a bent portion is, as with the second embodiment, formed by bending a mounting portion 9*a* to erect at substantially 90° relative to a connecting portion 9*b*. In a pressed article such as the angle member 9 worked like this, a radiused portion 9*e* is provided at a corner so that no stress is concentrated to a location where the dimensions are changed.

Incidentally, in the event that a stepped portion 5*b* like one provided in the fifth embodiment is not provided in the groove 5*a* in the insert 5 and the groove width of the groove portion 5*a* remains constant (d1), when the angle member 9 is inserted into the insert 5, the radiused portion 9*e* interferes with a corner portion at the end portion of the groove portion 5*a*, whereby the accuracy at which the angle member 9 is positioned relative to the insert 5 is decreased.

In contrast to this, according to the fifth embodiment, by providing the stepped portion 5*b* having the groove width d2 which is wider than the groove width d1 in the mounting portion 9*a* (groove width d2>d1) at the end portion of the groove portion 5*a* in the insert 5, the radiused portion 9*e* of the angle member 9 can be received within the stepped portion 5*b*, and therefore, there is caused no risk that the radiused portion 9*e* interferes with the end portion of the groove portion 5*a*. In addition, a parallel portion 9*f* formed on a connecting portion 9*b* of the angle member 9 can be caused to abut to a side 5*c* of the end portion of the insert 5 in a linear fashion.

By this configuration, the positioning of the angle member 9 relative to the insert 5 can be implemented easily and accurately.

(Other Embodiments)

While, in the heat exchanging units 7 according to the embodiments that have been described heretofore, the multistage core is used in which the tubes 2 are aligned in series in the direction in which the cooling air is caused to flow, the invention is not limited thereto.

In addition, while, in the embodiments, the corrugated fin is used as the fin 3, the invention is not limited thereto.

Additionally, while, in the embodiments, the inserts 5 and the angle member 9 are brazed together, the invention is not limited thereto, and for example, the inserts 5 and the angle member 9 may be welded to be joined together.

In addition, while, in the embodiments, the angle members 9 and the connecting bar 9*d* are fixed together with the detachable fastening means such as the bolts, the invention is not limited thereto, and for example, they may be joined together by brazing or welding.

Additionally, while, in the embodiments, the angle member 9 is fitted in the groove portion 5*a* in the insert 5, the invention is not limited thereto.

In addition, while, in the embodiments, the groove portion 5*a* is depressed towards the core portion 4 side, the invention is not limited thereto.

Additionally, while, in the embodiments, the angle member 9 is disposed such that the connecting portion 9*b* is positioned on the side of the core portion 4 which faces the downstream side of the airflow, the invention is not limited thereto, and the angle member 9 may be disposed such that the connecting portion 9*b* is positioned on the side of the core portion 4 which faces the upstream side of the airflow.

In addition, the invention may be such as to match the sprit and scope defined by claims attached hereto, and therefore, the invention is not limited to the aforesaid embodiments.

What is claimed is:

1. A heat exchanger comprising:

a plurality of heat exchanging units each having a core portion comprising, a plurality of tubes through which coolant passes and inserts provided on both sides of the core portion in such a manner as to extend in parallel with a longitudinal direction of the tubes so as to reinforce the core portion;

angle members fixed to the heat exchanging units at locations of the inserts which correspond to longitudinally intermediate portions of the tubes; and a connecting bar to which the angle member fixed to each of the plurality of heat exchanging units is connected.

2. A heat exchanger as set forth in claim 1, wherein the angle member is fixed to the heat exchanging unit while being fitted in a groove portion formed in the location of the insert which corresponds to the longitudinally intermediate portion of the tube.

3. A heat exchanger as set forth in claim 2, wherein the groove portion extends substantially in parallel with a direction in which an external fluid which exchanges heat with the fluid flows in a state where the groove portion is depressed towards the core portion side.

4. A heat exchanger as set forth claim 3, wherein the plurality of heat exchanging units are arranged in parallel with each other in a direction in which the external fluid flows.

5. A heat exchanger as set forth in claim 3, wherein a fin which is formed into a corrugated form as viewed in the direction in which the external fluid flows is joined to an external surface of the tube.

6. A heat exchanger as set forth in claim 2, wherein the angle member has mounting portions fitted in the groove portions and a connecting portion which extends across the core portion in such a manner as to connect the two mounting portions and is formed substantially into a U shape.

7. A heat exchanger as set forth in claim 6, wherein the groove portion has a stepped portion having a groove width which is wider than a groove width of an opening on the connecting portion side into which the mounting portion is fitted.

8. A heat exchanger as set forth in claim 6, wherein a gap through which the external fluid is caused to flow is provided between the connecting portion and the core portion.

9. A heat exchanger as set forth in claim 1, wherein the plurality of angle members and the connecting bar are connected to each other by detachable fastening means.

* * * * *